US010704844B2

(12) United States Patent
Xia et al.

(10) Patent No.: US 10,704,844 B2
(45) Date of Patent: Jul. 7, 2020

(54) HEAT EXCHANGER

(71) Applicant: SANHUA (HANGZHOU) MICRO CHANNEL HEAT EXCHANGER CO., LTD., Hangzhou (CN)

(72) Inventors: Huanghuang Xia, Hangzhou (CN); Hongming Chen, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 288 days.

(21) Appl. No.: 15/743,071

(22) PCT Filed: Jul. 5, 2016

(86) PCT No.: PCT/CN2016/088627
§ 371 (c)(1),
(2) Date: Jul. 6, 2018

(87) PCT Pub. No.: WO2017/008662
PCT Pub. Date: Jan. 19, 2017

(65) Prior Publication Data

US 2019/0078848 A1 Mar. 14, 2019

(30) Foreign Application Priority Data

Jul. 10, 2015 (CN) ..... 2015 2 0502739 U

(51) Int. Cl.
*F28F 9/02* (2006.01)
*F28F 17/00* (2006.01)
(Continued)

(52) U.S. Cl.
CPC ..... *F28F 17/005* (2013.01); *F24F 1/0059* (2013.01); *F24F 13/222* (2013.01);
(Continued)

(58) Field of Classification Search
CPC ..... F28F 17/005; F28F 1/126; F28F 1/128; F28F 1/32; F28F 17/00; F28F 19/00;
(Continued)

(56) References Cited

U.S. PATENT DOCUMENTS 5,209,290 A * 5/1993 Chigira ..... F28F 9/002 165/149
2007/0163760 A1* 7/2007 Seno ..... F28F 9/0253 165/132
2008/0030252 A1 2/2008 Cheng et al.

FOREIGN PATENT DOCUMENTS

CN 102889819 A 1/2013
CN 202902995 U 4/2013
(Continued)

OTHER PUBLICATIONS

Communication dated Feb. 7, 2019 transmitting the Extended European Search Report dated Feb. 1, 2019 for European Patent Application No. 16823809.5.
(Continued)

*Primary Examiner* — Henry T Crenshaw
*Assistant Examiner* — Kamran Tavakoldavani
(74) *Attorney, Agent, or Firm* — Howard & Howard Attorneys PLLC

(57) ABSTRACT

A heat exchanger including a first header and a second header; flat tubes, each having two ends connected to the first header and the second header respectively; a fin arranged between adjacent flat tubes; an input-output pipe welded to at least one header of the first header and the second header; and a water guide member disposed to the input-output pipe and/or the at least one header.

20 Claims, 9 Drawing Sheets

(51) Int. Cl.

| | |
|---|---|
| ***F28F 1/32*** | (2006.01) |
| ***F28F 19/00*** | (2006.01) |
| ***F28D 1/053*** | (2006.01) |
| ***F28F 1/12*** | (2006.01) |
| ***F24F 1/0059*** | (2019.01) |
| ***F24F 13/22*** | (2006.01) |
| *F24F 1/36* | (2011.01) |

(52) U.S. Cl.
CPC ..... *F28D 1/05366* (2013.01); *F28F 1/126* (2013.01); *F28F 1/32* (2013.01); *F28F 17/00* (2013.01); *F28F 19/00* (2013.01); *F28F 19/002* (2013.01); *F28F 19/004* (2013.01); *F28F 19/006* (2013.01); *F24F 1/36* (2013.01); *F28F 1/128* (2013.01)

(58) Field of Classification Search
CPC ..... F28F 19/002; F28F 19/004; F28F 19/006; F28F 25/00; F28F 2025/005; F28F 2265/22; F24F 1/0059; F24F 1/36; F24F 13/222; F24F 2013/227; F28D 1/05366
See application file for complete search history.

(56) References Cited

FOREIGN PATENT DOCUMENTS

| | | | |
|---|---|---|---|
| CN | 203100483 | U | 7/2013 |
| CN | 102889819 | B | 3/2014 |
| DE | 10127796 | C1 | 10/2002 |
| EP | 2520893 | A1 | 11/2012 |
| JP | 201025479 | A | 2/2010 |
| WO | 2008072859 | A1 | 6/2008 |
| WO | 2009140494 | A2 | 11/2009 |

OTHER PUBLICATIONS

International Search Report and Written Opinion of the International Searching Authority for PCT International Application No. PCT/CN2016/088627 dated Oct. 10, 2016.

* cited by examiner

HEAT EXCHANGER

CROSS-REFERENCE TO RELATED APPLICATIONS

This application is a national phase entry under 35 USC § 371 of PCT International Application No. PCT/CN2016/088627, filed Jul. 5, 2016, which is based on and claims priority to Chinese Patent Application No. 201520502739.2, filed Jul. 10, 2015, the entire contents of which are incorporated herein by reference.

BACKGROUND OF THE INVENTION

1. Field of the Invention

The present disclosure relates to a technical field of heat exchangers, and more particularly to a heat exchanger.

2. Description of the Related Art

Heat exchangers are often placed outdoors during applications, such as heat exchangers used in air conditioning systems. In a rainy or high humidity environment, water on a surface of the heat exchanger will accumulate and flow along a header and an input-output pipe to a joint of the header and the input-output pipe, and then be drained off along the header, which results in that a large amount of water accumulates at and flows across the joint of the header and the input-output pipe, such that the joint is easily corroded, and hence the service life of the heat exchanger is affected.

SUMMARY OF THE INVENTION

Embodiments of the present disclosure seek to solve at least one of the problems existing in the related art to at least some extent. For that reason, the present disclosure provides a heat exchanger that is able to effectively prevent corrosion due to water accumulation on surfaces and has an advantage of long service life.

To achieve the above objective, a heat exchanger is provided by embodiments of the present disclosure and includes: a first header and a second header; flat tubes, each having two ends connected to the first header and the second header respectively; a fin arranged between adjacent flat tubes; an input-output pipe welded to at least one header of the first header and the second header; and a water guiding member disposed to the input-output pipe and/or the at least one header.

The heat exchanger according to embodiments of the present disclosure is able to effectively prevent corrosion due to water accumulation on surfaces and has the advantage of long service life.

Additionally, the heat exchanger according to embodiments of the present disclosure has the following technical features.

The water guiding member is arranged adjacent to a welding position where the input-output pipe and the at least one header are welded.

The water guiding member is disposed to the input-output pipe.

In one embodiment, the water guiding member is a water guiding disc fitted over the input-output pipe.

The water guiding disc has a notch, which allows the water guiding disc to be fitted over the input-output pipe and extends along a radial direction of the water guiding disc.

A lower edge of the water guiding disc is provided with a water leading bar extending downwards from the water guiding disc.

The water guiding member may be a water retaining block, an upper surface of the water retaining block is provided with a groove fitted with the input-output pipe, and in a cross section of the input-output pipe, at least a lower half of the input-output pipe is fitted in the groove.

The heat exchanger further includes: a bracket connected with the at least one header; and an elastic member arranged on the bracket, the water retaining block may include a flexible block and arranged on the elastic member.

The input-output pipe includes an inlet pipe and an outlet pipe, the inlet pipe and the outlet pipe are simultaneously welded to one of the first header and the second header or are respectively welded to the first header and the second header, and the water guiding member is disposed to at least one of the inlet pipe and the outlet pipe.

The water guiding member is disposed to the at least one header and located above a welding position where the input-output pipe and the at least one header are welded.

In one embodiment, the water guiding member may be formed as a water guiding disc fitted over the at least one header.

The water guiding disc has a notch, which allows the water guiding disc to be fitted over the at least one header and extends along a radial direction of the water guiding disc.

An edge of the water guiding disc is provided with a water discharge port.

The water guiding disc is provided with a water leading bar extending downwards from the water discharge port.

The input-output pipe comprises an inlet pipe and an outlet pipe. The inlet pipe and the outlet pipe are simultaneously welded to one header of the first header and the second header, and the water guiding member is provided to the one header above at least one welding position of a welding position where the inlet pipe and the one header are welded and another welding position where the outlet pipe and the one header are welded. Or, the inlet pipe and the outlet pipe are connected to the first header and the second header respectively, and the water guiding member is provided to at least one of the first header and the second header.

The input-output pipe comprises an inlet pipe welded with the first header and an outlet pipe welded with the second header, each of the inlet pipe and the outlet pipe is provided with the water guiding member, and each of the first header and the second header is provided with the water guiding member.

The water guiding member of the first header is connected with the water guiding member of the inlet pipe by a water leading plate, and the water guiding member of the second header is connected with the water guiding member of the outlet pipe by another water leading plate.

The input-output pipe comprises an inlet pipe welded with the first header and an outlet pipe welded with the first header, each of the inlet pipe and the outlet pipe is provided with the water guiding member, and the first header is provided with the water guiding member.

The first header is provided with two water guiding members, one of the two water guiding members of the first header is connected with the water guiding member of the inlet pipe by a water leading plate, and the other one of the two water guiding members of the first header is connected with the water guiding member of the outlet pipe by another water leading plate.

The water guiding member may be in the form of a water guiding disc, and the water guiding disc has a central mounting hole, and a notch in communication with the central mounting hole and extending along a radial direction of the water guiding disc.

Other objects, features and advantages of the present invention will be readily appreciated as the same becomes better understood after reading the subsequent description taken in connection with the accompanying drawings

BRIEF DESCRIPTION OF THE DRAWINGS

Other advantages of the invention will be readily appreciated as the same becomes better understood by reference to the following detailed description when considered in connection with the accompanying drawings, wherein.

Figure 1:
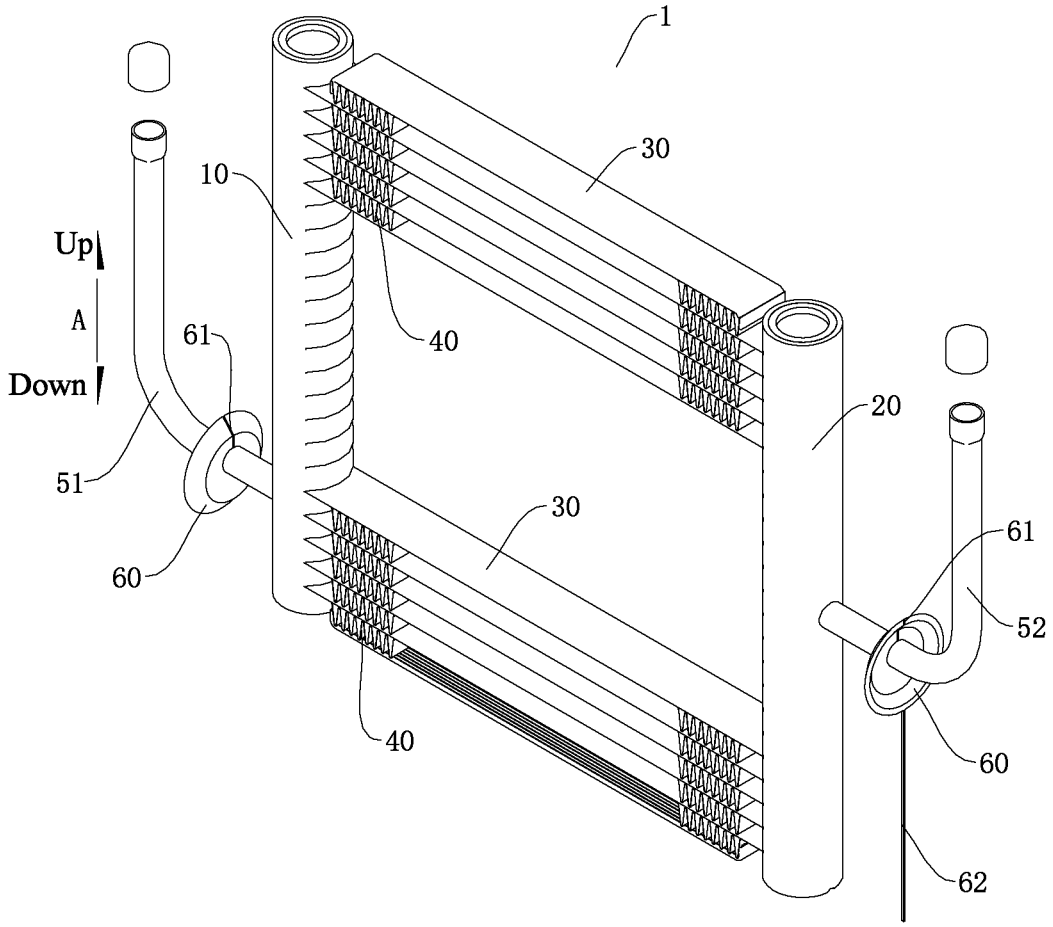
FIG. 1 is a schematic view of a heat exchanger according to embodiments of the present disclosure.

REFERENCE NUMERALS heat exchanger 1, first header 10, second header 20, flat tube 30, fin 40, inlet pipe 51, outlet pipe 52, water guiding member 60, notch 61, water leading bar 62, bracket 63, elastic member 64, water discharge port 65, water leading plate 66.

DETAILED DESCRIPTION OF THE INVENTION

Embodiments of the present disclosure will be described in detail and examples of the embodiments will be illustrated in the accompanying drawings. The same or similar elements and the elements having same or similar functions are denoted by like reference numerals throughout the descriptions. The embodiments described herein with reference to the drawings are explanatory, which aim to illustrate the present disclosure, but shall not be construed to limit the present disclosure.

A heat exchanger 1 according to embodiments of the present disclosure will be described with reference to the drawings. Those skilled in the art should understand that an up-and-down direction mentioned below refers to an up-and-down direction when the heat exchanger 1 is normally used.

As illustrated in FIGS. 1 to 9, the heat exchanger 1 includes a first header 10, a second header 20, flat tubes 30, a fin 40, an input-output pipe and a water guiding member 60.

The first header 10 and the second header 20 are disposed vertically and spaced apart from each other. The flat tube 30 is disposed horizontally, and has two ends connected with the first header 10 and the second header 20 respectively. The fin 40 may take the form of a corrugated fin and disposed between adjacent flat tubes 30. The input-output pipe is welded to at least one header of the first header 10 and the second header 20. The water guiding member 60 is disposed to the input-output pipe and/or the at least one header. In other words, the water guiding member 60 may be disposed to the input-output pipe, or may be disposed to the header welded with the input-output pipe, or may be disposed to both of the input-output pipe and the header welded with the input-output pipe.

The input-output pipe includes an inlet pipe 51 and an outlet pipe 52. The inlet pipe 51 and the outlet pipe 52 may be simultaneously disposed to one of the first header 10 and the second header 20 (as illustrated in FIGS. 3, 5, 8 and 9). Or, the inlet pipe 51 may be disposed to the first header 10 and the outlet pipe 52 may be disposed to the second header 20 (as illustrated in FIGS. 1, 2, 4, 6 and 7).

For the heat exchanger 1 according to embodiments of the present disclosure, by providing the water guiding member 60 to the input-output pipe and/or the header welded with the input-output pipe, water accumulated on a specific part of a surface of the heat exchanger 1 can be drained off to the outside of the heat exchanger 1 by the water guiding member 60, so as to prevent water from accumulating or flowing across the surface of the heat exchanger 1. For example, it is possible to prevent water from accumulating at a welded joint of the input-output pipe and the header, and especially, when the heat exchanger 1 is used as an evaporator or is applied to a heat pump, it is possible to prevent rainwater from flowing across a weak area of the heat exchanger 1 that is exposed to the air, so as to prevent metal ions or other active media entrained in the rain from corroding the surface of the heat exchanger 1, thereby greatly reducing a risk of corrosion of the heat exchanger 1 and hence prolonging a service life of the heat exchanger 1. Thus, the heat exchanger 1 according to embodiments of the present disclosure is able to avoid corrosion due to water accumulation on the surface thereof and has an advantage of long service life.

The heat exchanger 1 according to specific embodiments of the present disclosure will be described with reference to the drawings.

In some specific embodiments of the present disclosure, as shown in FIGS. 1-9, the heat exchanger 1 according to the embodiments of the present disclosure includes the first header 10, the second header 20, the flat tubes 30, the fin 40, the input-output pipe and the water guiding member 60.

Further, the water guiding member 60 is disposed adjacent to a welding position where the input-output pipe and the at least one header are welded. The water on the surface of the heat exchanger 1 will be discharged out of the heat exchanger 1 by the water guiding member 60 before flowing to the welded joint of the input-output pipe and the header, so as to more effectively prevent water from accumulating at the welded joint of the input-output pipe and the header.

Figure 2:
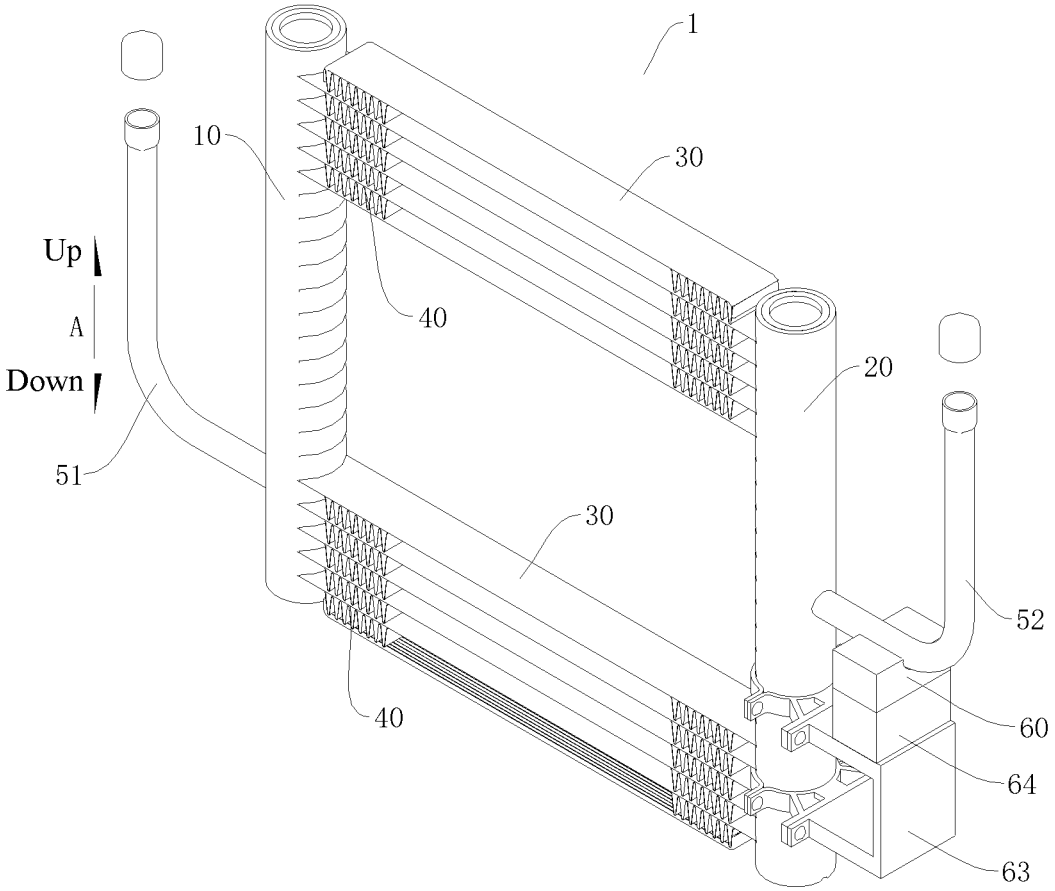
FIG. 2 is a schematic view of a heat exchanger according to a first optional embodiment of the present disclosure.
Figure 3:
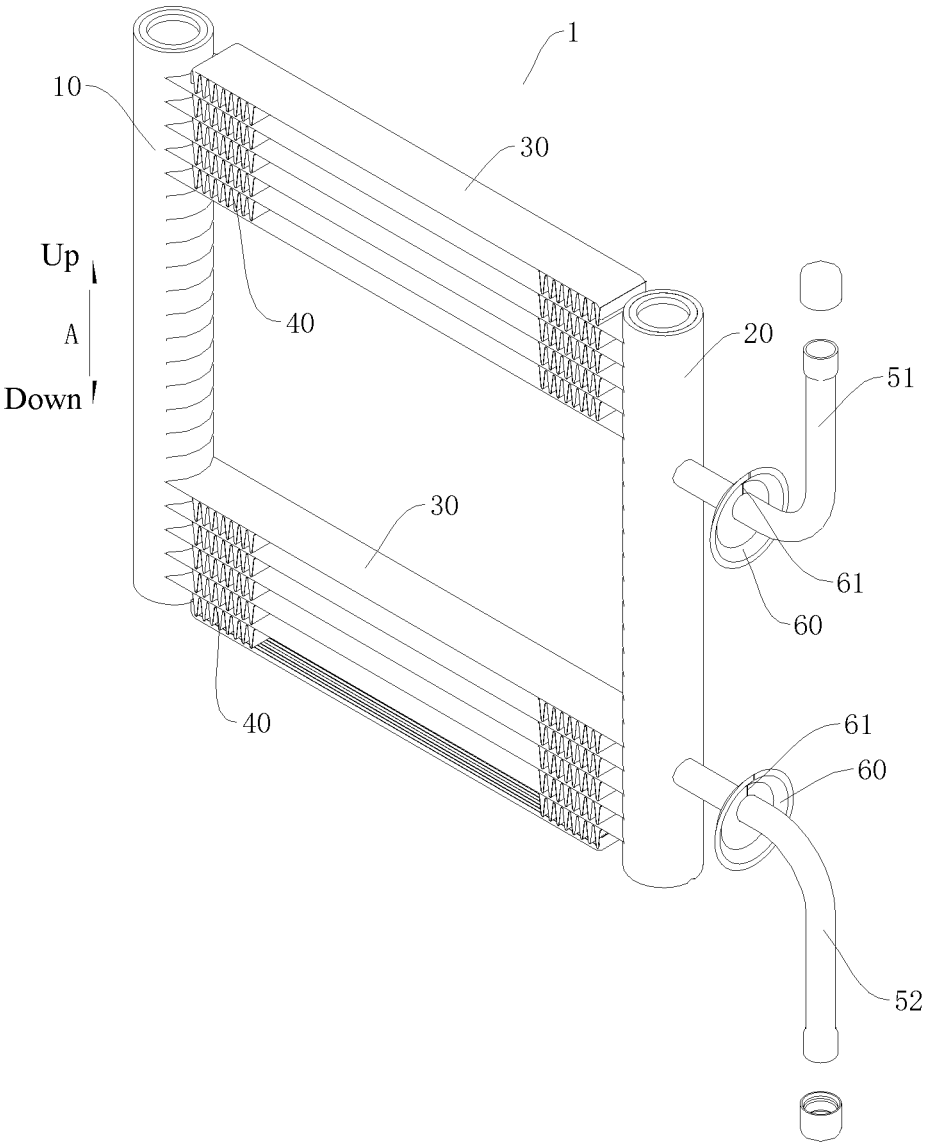
FIG. 3 is a schematic view of a heat exchanger according to a second optional embodiment of the present disclosure.

In some specific examples of the present disclosure, as shown in FIGS. 1-3, the water guiding member 60 is disposed to the input-output pipe, and the water guiding member 60 can prevent water on the input-output pipe from flowing along an outer wall of the input-output pipe to the welded joint of the input-output pipe and the header.

Optionally, as illustrated in FIG. 1, the water guiding member 60 is a water guiding disc fitted over the input-output pipe. The water guiding disc is a circular or oval disc with an opening facing away from the header welded to the input-output pipe, and a peripheral edge of the water guiding disc is provided with a circle of protrusion extending outwardly. The water guiding disc collects water flowing along the input-output pipe and guides the collected water to be discharged under action of gravity, so as to prevent water on the input-output pipe from flowing to the welded joint of the input-output pipe and the header. In addition, the provision of the water guiding disc will not affect a heat exchange channel or increase an air resistance, thereby avoiding influences on a heat exchange performance.

Advantageously, as illustrated in FIG. 1, the water guiding disc (i.e. the water guiding member 60) can be made of rubber or other soft and corrosion-resistant materials, and the water guiding disc has a notch 61 extending along a radial direction of the water guiding disc and cutting the water guiding disc. The water guiding disc may allow the input-output pipe to directly pass through itself, so as to be fitted over the input-output pipe, or the water guiding disc may also be mounted to the input-output pipe in a clipping manner by the notch 61, such that the mounting of the water guiding disc can be facilitated, and can be realized in flexible manners so as to adapt to input-output pipes of different pipe diameters.

Further, as illustrated in FIG. 1, a lower edge of the water guiding disc (i.e. the water guiding member 60) is provided with a water leading bar 62 extending downwards from the water guiding disc, and the water leading bar 62 can lead the water on the water guiding disc to flow downwards and out of the heat exchanger 1, so as to further prevent the water on the input-output pipe from flowing to the welded joint of the input-output pipe and the header.

In some specific embodiments of the present disclosure, as illustrated in FIG. 2, the water guiding member 60 is a water retaining block, an upper surface of the water retaining block is provided with a groove fitted with the input-output pipe, and in a cross section of the input-output pipe, at least a lower half of the input-output pipe is fitted in the groove, i.e. the water retaining block and a wall of at least the lower half of the input-output pipe fit closely together. Hence, the water on the input-output pipe will be retained by the water retaining block when flowing to the water retaining block, and cannot continue flowing to the welded joint of the input-output pipe and the header.

Specifically, as illustrated in FIG. 2, the header welded with the input-output pipe is provided with a bracket 63, the bracket 63 may be fastened to the header through a hoop, a tie or a spring, an elastic member 64 is provided on the bracket 63, and the water guiding disc (i.e. the water guiding member 60) is formed as a flexible block and disposed on the elastic member 64. The elastic member 64 can ensure that the water retaining block and the input-output pipe fit closely together, and the bracket 63 supports the elastic member 64 and the water retaining block. Those skilled in the art could understand that the bracket 63 can also serve as a mounting bracket for the heat exchanger 1 so as to facilitate the assembling of the heat exchanger 1 and units.

In some specific examples of the present disclosure, as illustrated in FIGS. 1 and 2, the inlet pipe 51 is welded to the first header 10 and the outlet pipe 52 is welded to the second header 20. A heat transfer medium enters the first header 10 through the inlet pipe 51, flows into the second header 20 through the flat tubes 30, and finally flows out of the outlet pipe 52. At least one of the inlet pipe 51 and the outlet pipe 52 is provided with the water guiding member 60 adjacent to the corresponding header.

As illustrated in FIG. 3, the inlet pipe 51 and the outlet pipe 52 may be simultaneously welded to one header of the first header 10 and the second header 20, and the first header 10 and the second header 20 each are provided with a baffle therein. After entering from the inlet pipe 51, a cooling medium flows in a serpentine manner between the first header 10 and the second header 20 through the flat tubes 30 under the guidance of the baffles, and finally flows out of the outlet pipe 52. At least one of the inlet pipe 51 and the outlet pipe 52 is provided with the water guiding member 60 adjacent to the corresponding header.

Figure 4:
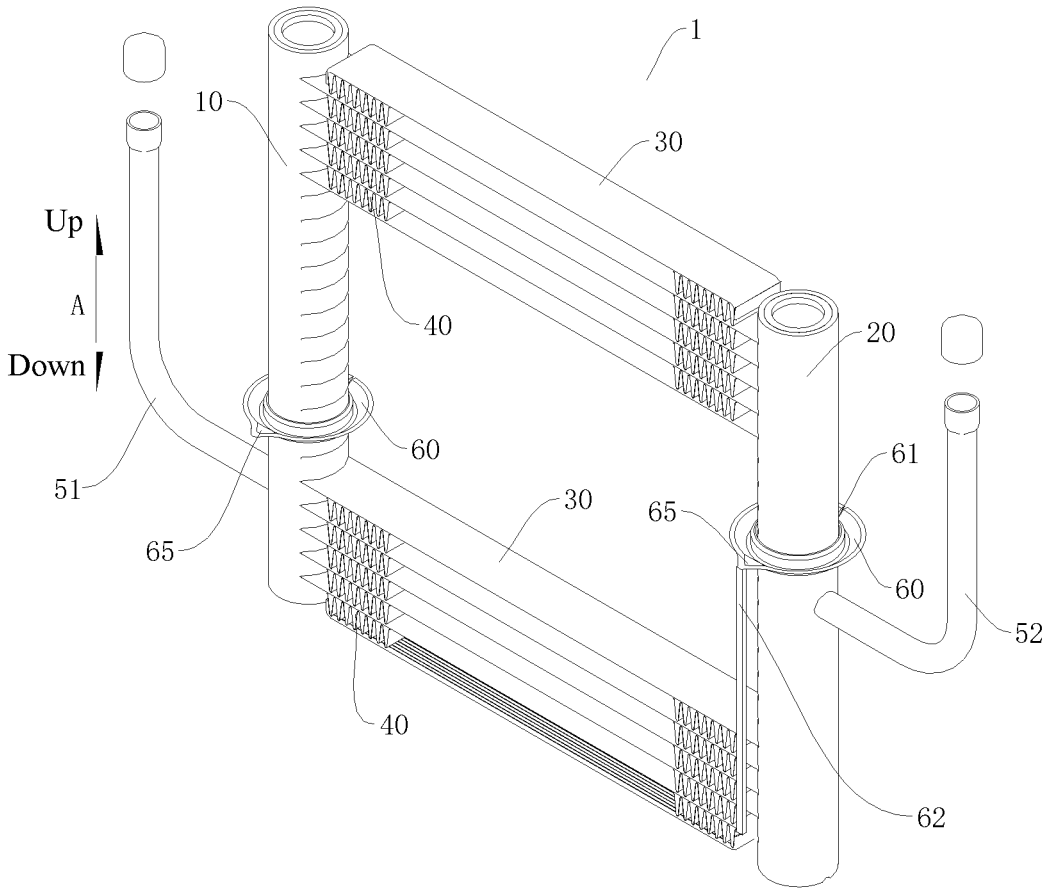
FIG. 4 is a schematic view of a heat exchanger according to a third optional embodiment of the present disclosure.
Figure 5:
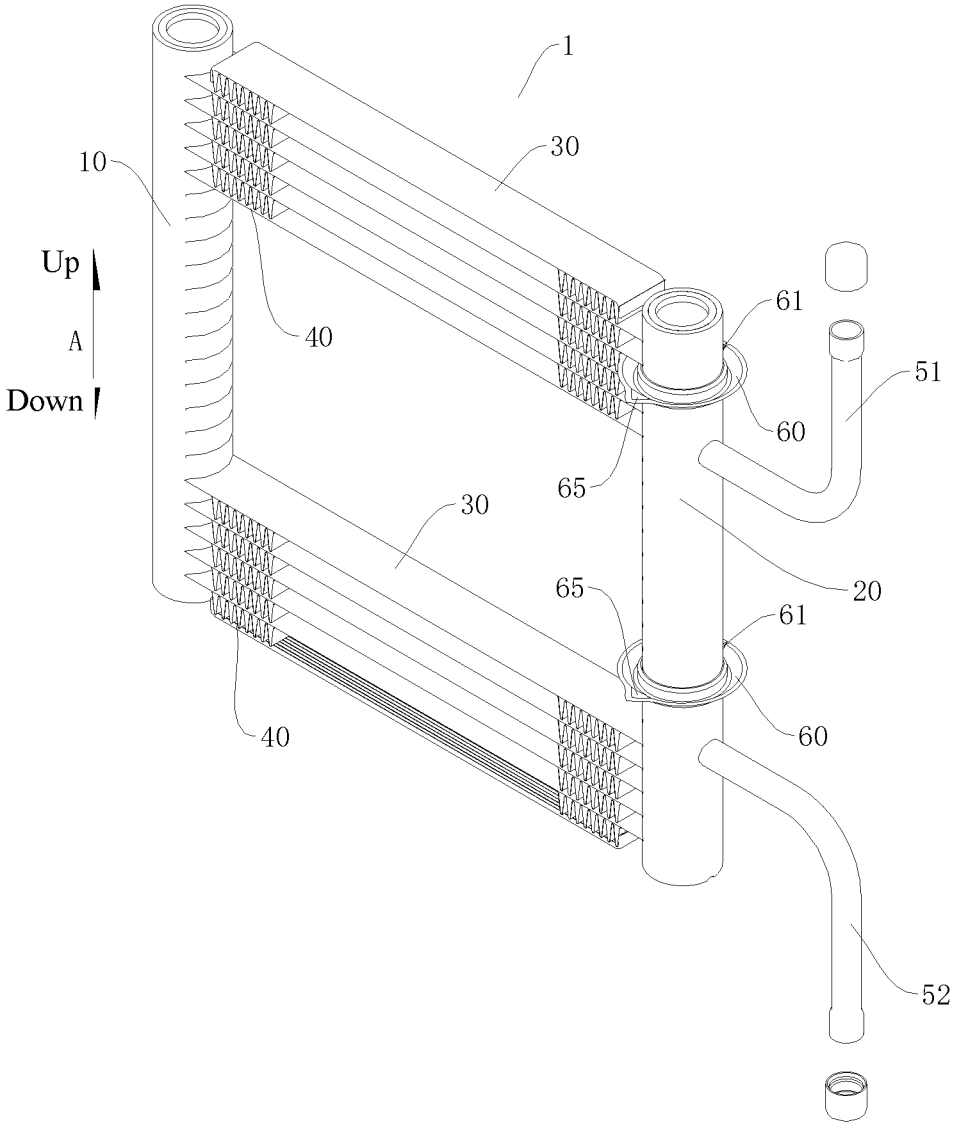
FIG. 5 is a schematic view of a heat exchanger according to a fourth optional embodiment of the present disclosure.

In some specific embodiments of the present disclosure, as illustrated in FIGS. 4 and 5, the water guiding member 60 is disposed to the header welded with the input-output pipe, and the water guiding member 60 is located above the welding position where the input-output pipe and the header are welded, such that the water guiding member 60 can prevent water on the header from flowing along an outer wall of the header to the welded joint of the input-output pipe and the header.

Optionally, as illustrated in FIGS. 4 and 5, the water guiding member 60 is a water guiding disc fitted over the header. The water guiding disc is a circular or oval disc with an opening facing upwards, and a peripheral edge of the water guiding disc is provided with a circle of protrusion extending outwardly. The water guiding disc collects water flowing along the header to prevent the water on the header from flowing to the welded joint of the input-output pipe and the header. In addition, the provision of the water guiding disc will not affect a heat exchange channel or increase an air resistance, thereby avoiding an influence on the heat exchange performance.

Advantageously, as illustrated in FIGS. 4 and 5, the water guiding disc (i.e. the water guiding member 60) may be made of rubber or other soft and corrosion-resistant materials, and the water guiding disc has a notch 61 extending along a radial direction of the water guiding disc and cutting the water guiding disc. The water guiding disc may allow the header to directly pass through itself, so as to be fitted over the header, or the water guiding disc may be mounted to the header in a clipping manner by the notch 61, such that the mounting of the water guiding disc can be facilitated, and can be realized in flexible manners so as to adapt to input-output pipes of different pipe diameters.

Further, as illustrated in FIG. 4, an edge of the water guiding disc (i.e. the water guiding member 60) is provided with a water discharge port 65, and the water guiding disc is provided with a water leading bar 62 extending downwards from the water discharge port 65. Thus, after the water guiding disc is full of the collected water, the collected water overflows from the water discharge port 65 and flows downwards along the water leading bar 62 to be discharged out of the heat exchanger 1.

In some specific examples of the present disclosure, as illustrated in FIG. 4, the inlet pipe 51 is connected to the first header 10 and the outlet pipe 52 is connected to the second header 20. The heat transfer medium enters the first header 10 through the inlet pipe 51, flows into the second header 20 through the flat tubes 30, and finally flows out of the outlet pipe 52. At least one of the first header 10 and the second header 20 is provided with the water guiding member 60.

As illustrated in FIG. 5, the inlet pipe 51 and the outlet pipe 52 may also be simultaneously welded to one header of the first header 10 and the second header 20, and the first header 10 and the second header 20 each are provided with a baffle therein. After entering from the inlet pipe 51, the cooling medium flows in a serpentine manner between the first header 10 and the second header 20 through the flat tubes 30 under the guidance of the baffles, and finally flows out of the outlet pipe 52. On the one header simultaneously welded with the inlet pipe 51 and the outlet pipe 52, the water guiding member 60 is provided above at least one welding position of a welding position where the inlet pipe 51 and the one header are welded and another welding position where the outlet pipe 52 and the one header are welded. In other words, at least one water guiding member 60 is provided to the one header simultaneously welded with the inlet pipe 51 and the outlet pipe 52, and located above the corresponding welding position.

Figure 6:
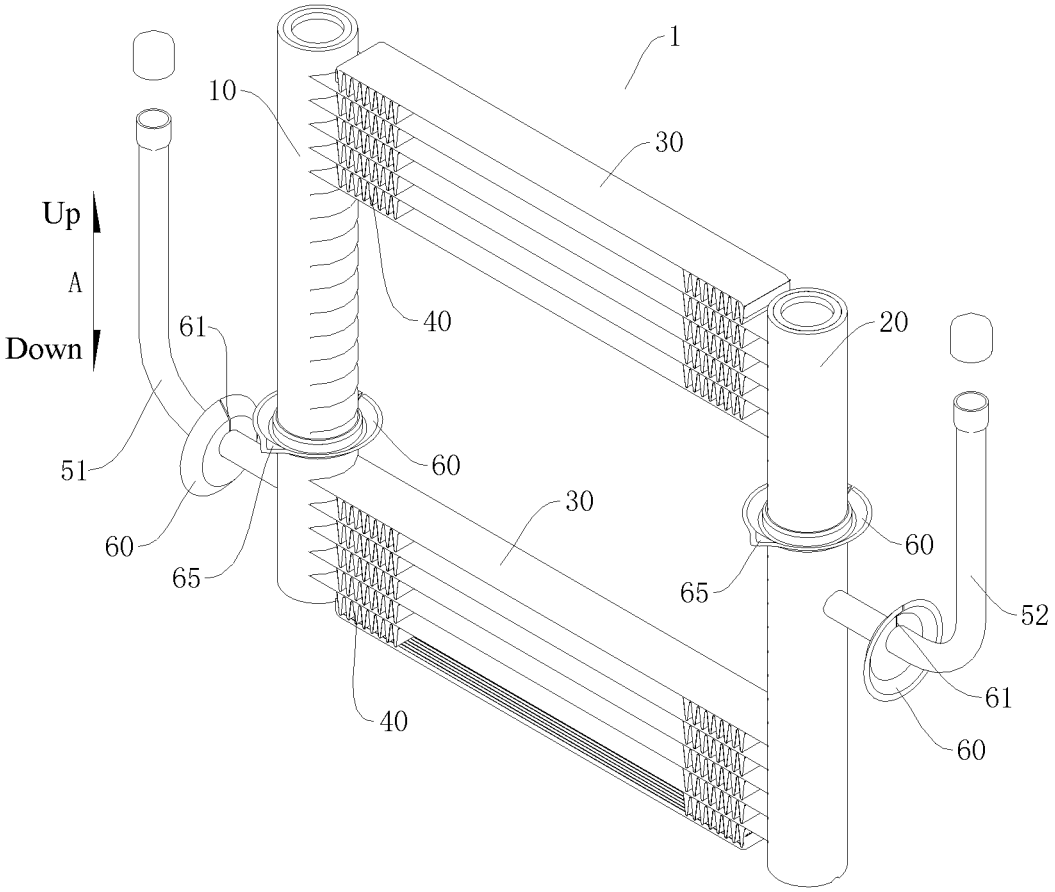
FIG. 6 is a schematic view of a heat exchanger according to a fifth optional embodiment of the present disclosure.
Figure 7:
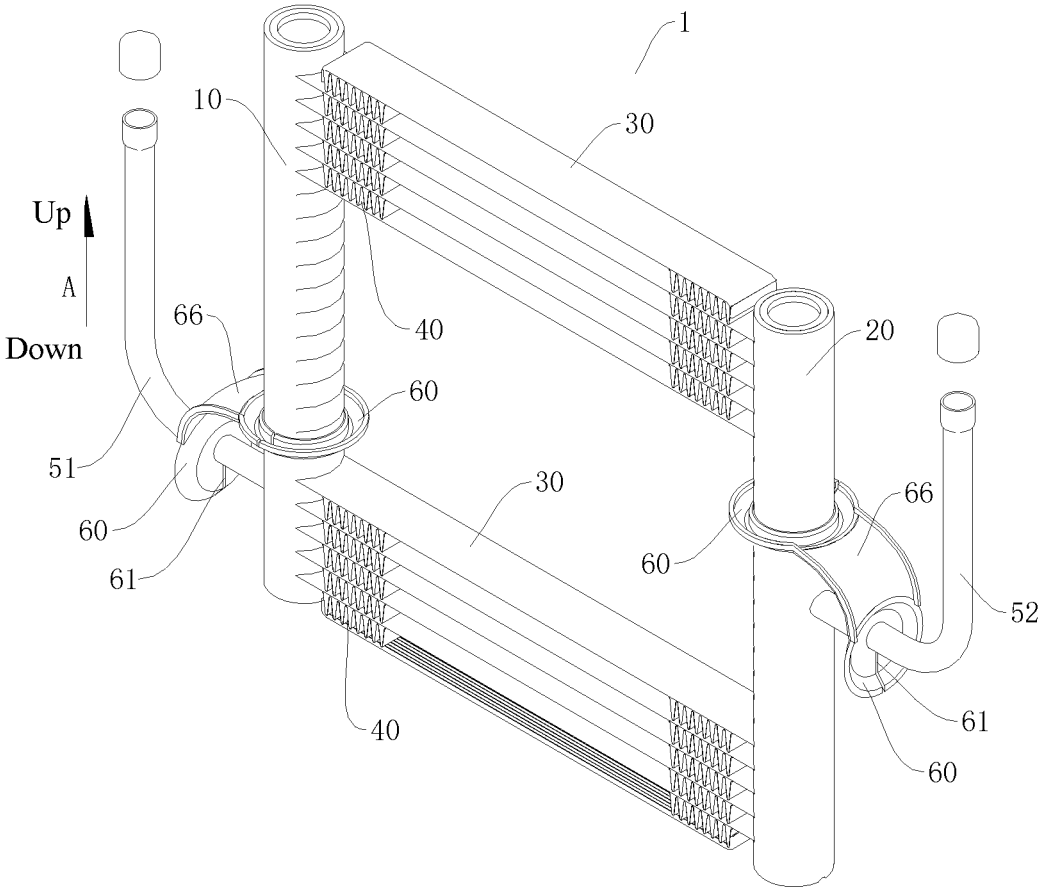
FIG. 7 is a schematic view of a heat exchanger according to a sixth optional embodiment of the present disclosure.

In some specific embodiments of the present disclosure, as illustrated in FIGS. 6 and 7, the inlet pipe 51 is welded to the first header 10, while the outlet pipe 52 is welded to the second header 20. The heat transfer medium enters the first header 10 through the inlet pipe 51, then flows into the second header 20 through the flat tubes 30, and finally flows out of the outlet pipe 52. The inlet pipe 51, the outlet pipe 52, the first header 10 and the second header 20 each are provided with the water guiding member 60. Thus, it is possible to prevent water on the inlet pipe 51, the outlet pipe 52, the first header 10 and the second header 20 from flowing to a welded joint of the inlet pipe 51 and the first header 10 and a welded joint of the outlet pipe 52 and the second header 20, so as to reduce a risk of corroding the welded joint of the inlet pipe 51 and the first header 10 and the welded joint of the outlet pipe 52 and the second header 20, thereby improving the service life of the heat exchanger 1.

Optionally, as illustrated in FIGS. 6 and 7, the water guiding member 60 is in the form of a circular or oval water guiding disc, a peripheral edge of the water guiding disc is provided with a circle of protrusion extending outwardly, and the water guiding disc may be made of rubber or other soft and corrosion-resistant materials. The water guiding disc has a central mounting hole for fitting the water guiding disc over the corresponding pipe, and the water guiding disc is further provided with a notch 61 in communication with the central mounting hole and extending along a radial direction of the water guiding disc, in which the notch 61 can further facilitate the mounting of the water guiding disc.

Further, as illustrated in FIG. 7, the water guiding member 60 of the first header 10 is connected with the water guiding member 60 of the inlet pipe 51 by a water leading plate 66, and the water guiding member 60 of the second header 20 is connected with the water guiding member 60 of the outlet pipe 52 by another water leading plate 66. Each water leading plate 66 is an arc plate facing upwards and protruding away from the welding position. Thus, two water leading plates 66 and four water guiding members 60 can be used to separate the welded joint of the inlet pipe 51 and the first header 10 and the welded joint of the outlet pipe 52 and the second header 20 from the external environment, so as to further prevent water from accumulating or flowing across the welded joint of the inlet pipe 51 and the first header 10 and the welded joint of the outlet pipe 52 and the second header 20.

Figure 8:
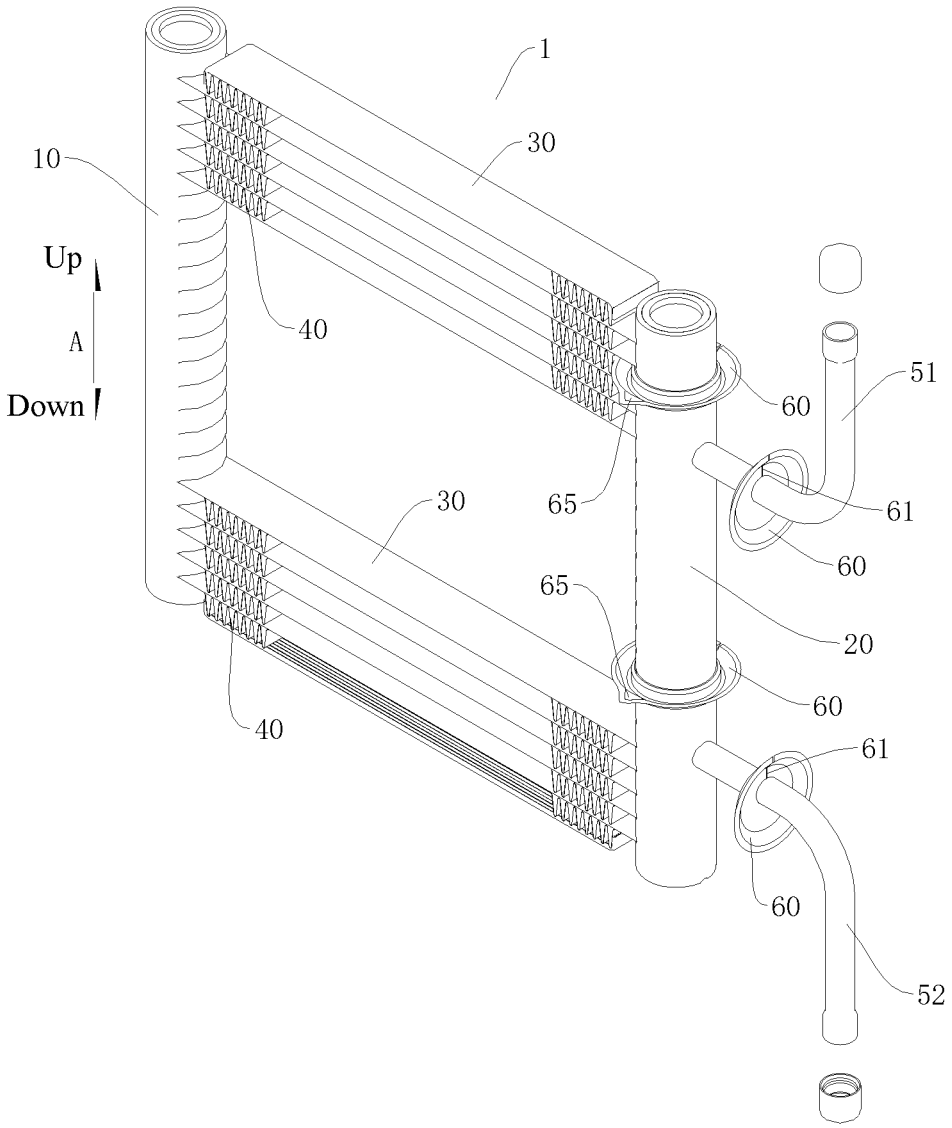
FIG. 8 is a schematic view of a heat exchanger according to a seventh optional embodiment of the present disclosure.
Figure 9:
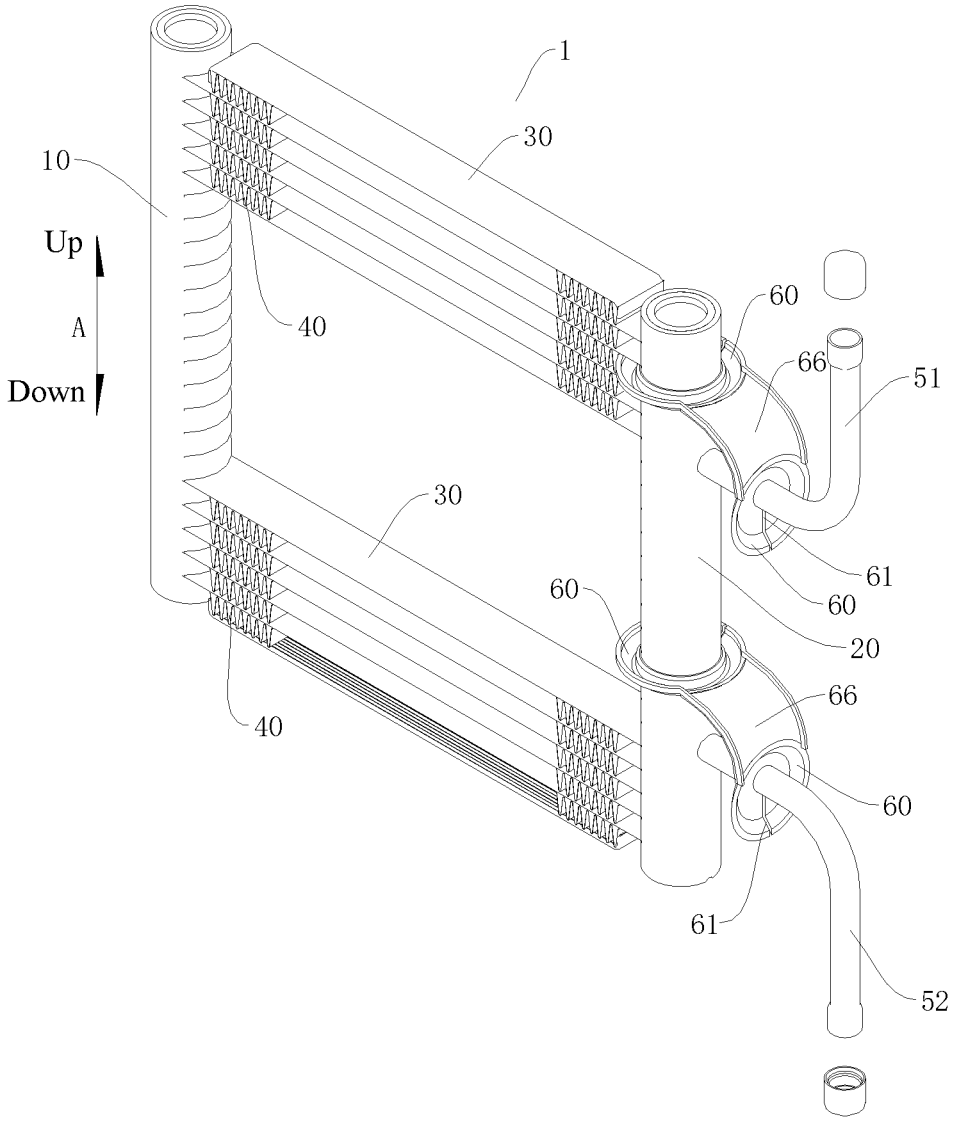
FIG. 9 is a schematic view of a heat exchanger according to an eighth optional embodiment of the present disclosure.

In some specific embodiments of the present disclosure, as illustrated in FIGS. 8 and 9, the inlet pipe 51 and the outlet pipe 52 are both welded to the first header 10, and the first header 10 and the second header 20 both are provided with a baffle therein. After entering the first header 10 from the inlet pipe 51, the cooling medium flows in a serpentine manner between the first header 10 and the second header 20 through the flat tubes 30 under the guidance of the baffles, finally flows back to the first header 10 and flows out of the outlet pipe 52. The inlet pipe 51, the outlet pipe 52 and the first header 10 are provided with the water guiding member 60 respectively. Those skilled in the art should understand that the first header 10 may be provided with one water guiding member 60, and this water guiding member 60 is located above the higher one of the inlet pipe 51 and the outlet pipe 52. The first header 10 may also be provided with two water guiding members 60, one of the two water guiding members 60 is located above the inlet pipe 51 and the other one of the two water guiding members 60 is located above the outlet pipe 52. Thus, it is possible to prevent water on the inlet pipe 51, the outlet pipe 52 and the first header 10 from flowing to a welded joint of the inlet pipe 51 and the first header 10 and a welded joint of the outlet pipe 52 and the first header 10, so as to reduce a risk of corroding the welded joint of the inlet pipe 51 and the first header 10 and the welded joint of the outlet pipe 52 and the first header 10, thereby prolonging the service life of the heat exchanger 1.

Optionally, as illustrated in FIGS. 8 and 9, the water guiding member 60 is formed as a circular or oval water guiding disc, a peripheral edge of the water guiding disc is provided with a circle of protrusion extending outwardly, and the water guiding disc may be made of rubber or other soft and corrosion-resistant materials. The water guiding disc has a central mounting hole for fitting the water guiding disc over the corresponding pipe, and the water guiding disc is further provided with a notch 61 in communication with the central mounting hole and extending along a radial direction of the water guiding disc, in which the notch 61 can further facilitate the mounting of the water guiding disc.

Further, as illustrated in FIG. 9, the first header 10 is provided with two water guiding members 60, one of the two water guiding members 60 is located above the inlet pipe 51 and the other one of the two water guiding members 60 is located above the outlet pipe 52. The two water guiding members 60 of the first header 10 are connected with the guiding member 60 of the inlet pipe 51 by a water leading plate 66 and with the guiding member 60 of the outlet pipe 52 by another water leading plate 66. Each water leading plate 66 is formed as an arc plate facing upwards and protruding away from the welding position. Thus, two water leading plates 66 and four water guiding members 60 can be used to separate the welded joint of the inlet pipe 51 and the first header 10 and the welded joint of the outlet pipe 52 and the first header 10 from the external environment, so as to further prevent water from accumulating or flowing across the welded joint of the inlet pipe 51 and the first header 10 and the welded joint of the outlet pipe 52 and the first header 10.

Other configurations and operations of the heat exchanger 1 according to embodiments of the present disclosure are known to those skilled in the art, which will not be elaborated herein.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are only used to simplify description of the present disclosure, and do not indicate or imply that the device or element referred to must have a particular orientation, or constructed or operated in a particular orientation. Thus, these terms cannot be constructed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, modifications, alternatives and variations can be made in the embodiments without departing from the scope of the present disclosure.

What is claimed is:

1. A heat exchanger, comprising:

a first header and a second header;

flat tubes, each having two ends connected to the first header and the second header respectively;

a fin arranged between adjacent flat tubes;

an input-output pipe welded to at least one header of the first header and the second header; and a first water guiding member mounted to the at least one header and located above a welding position, where the input-output pipe and the at least one header are welded, along an axial direction of the at least one header.

2. The heat exchanger as set forth in claim 1, wherein the first water guiding member is arranged adjacent to the welding position where the input-output pipe and the at least one header are welded.

3. The heat exchanger as set forth in claim 1, further comprising a second water guiding member mounted to the input-output pipe.

4. The heat exchanger as set forth in claim 3, wherein the second water guiding member is a water guiding disc fitted over the input-output pipe.

5. The heat exchanger as set forth in claim 4, wherein the water guiding disc has a notch, which allows the water guiding disc to be fitted over the input-output pipe and extends along a radial direction of the water guiding disc.

6. The heat exchanger as set forth in claim 4, wherein a lower edge of the water guiding disc is provided with a water leading bar extending downwards from the water guiding disc.

7. The heat exchanger as set forth in claim 3, wherein the input-output pipe comprises an inlet pipe and an outlet pipe, the inlet pipe and the outlet pipe are simultaneously welded to one of the first header and the second header or are respectively welded to the first header and the second header, and the second water guiding member is mounted to at least one of the inlet pipe and the outlet pipe.

8. The heat exchanger as set forth in claim 1, wherein the first water guiding member is a water guiding disc fitted over the at least one header.

9. The heat exchanger as set forth in claim 8, wherein the water guiding disc has a notch, which allows the water guiding disc to be fitted over the at least one header and extends along a radial direction of the water guiding disc.

10. The heat exchanger as set forth in claim 8, wherein an edge of the water guiding disc is provided with a water discharge port.

11. The heat exchanger as set forth in claim 10, wherein the water guiding disc is provided with a water leading bar extending downwards from the water discharge port.

12. The heat exchanger as set forth in claim 1, wherein the input-output pipe comprises an inlet pipe and an outlet pipe, the inlet pipe and the outlet pipe are simultaneously welded to one header of the first header and the second header, and the first water guiding member is provided to the one header above at least one welding position of a welding position where the inlet pipe and the one header are welded and another welding position where the outlet pipe and the one header are welded; or the inlet pipe and the outlet pipe are connected to the first header and the second header respectively, and the first water guiding member is provided to at least one of the first header and the second header.

13. The heat exchanger as set forth in claim 1, wherein the input-output pipe comprises an inlet pipe welded with the first header and an outlet pipe welded with the second header, each of the inlet pipe and the outlet pipe is provided with a second water guiding member, and each of the first header and the second header is provided with the first water guiding member.

14. The heat exchanger as set forth in claim 13, wherein the first water guiding member of the first header is connected with the second water guiding member of the inlet pipe by a water leading plate, and the first water guiding member of the second header is connected with the second water guiding member of the outlet pipe by another water leading plate.

15. The heat exchanger as set forth in claim 1, wherein the input-output pipe comprises an inlet pipe welded with the first header and an outlet pipe welded with the first header, each of the inlet pipe and the outlet pipe is provided with a second water guiding member, and the first header is provided with the first water guiding member.

16. The heat exchanger as set forth in claim 15, wherein the first header is provided with two first water guiding members, one of the two first water guiding members of the first header is connected with the second water guiding member of the inlet pipe by a water leading plate, and the other one of the two first water guiding members of the first header is connected with the second water guiding member of the outlet pipe by another water leading plate.

17. The heat exchanger as set forth in claim 13, wherein each of the first water guiding member and the second water guiding member is a water guiding disc, and the water guiding disc has a central mounting hole, and a notch in communication with the central mounting hole and extending along a radial direction of the water guiding disc.

18. A heat exchanger, comprising:

a first header and a second header;

flat tubes, each having two ends connected to the first header and the second header respectively;

a fin arranged between adjacent flat tubes;

an input-output pipe welded to at least one header of the first header and the second header; and a water guiding member mounted to the input-output pipe and/or the at least one header, wherein the water guiding member is configured as a water retaining block, an upper surface of the water retaining block is provided with a groove configured to be fitted with the input-output pipe, and in a cross section of the input-output pipe, at least a lower half of the input-output pipe is fitted in the groove.

19. The heat exchanger according to claim 18, further comprising:

a bracket connected with the at least one header; and an elastic member arranged on the bracket, the water retaining block being configured as a flexible block and arranged on the elastic member.

20. A heat exchanger, comprising:

a first header and a second header;

flat tubes, each having two ends connected to the first header and the second header respectively;

a fin arranged between adjacent flat tubes;

an input-output pipe welded to at least one header of the first header and the second header; and a water guiding member mounted to the input-output pipe and spaced apart from a welding position where the input-output pipe and the at least one header are welded.

* * * * *